US008198816B2

(12) United States Patent
Imamura et al.

(10) Patent No.: US 8,198,816 B2
(45) Date of Patent: Jun. 12, 2012

(54) EXTRA HIGH PRESSURE LAMP HAVING A NOVEL ELECTRODE STRUCTURE

(75) Inventors: Atsushi Imamura, Hyogo (JP); Takashi Yamashita, Hyogo (JP); Tetsu Takemura, Hyogo (JP); Nobuhiro Nagamachi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 195 days.

(21) Appl. No.: 12/654,334

(22) Filed: Dec. 17, 2009

(65) Prior Publication Data

US 2010/0156288 A1 Jun. 24, 2010

(30) Foreign Application Priority Data

Dec. 19, 2008 (JP) ..... 2008-324409
Jun. 22, 2009 (JP) ..... 2009-147808

(51) Int. Cl.
*H01J 17/26* (2012.01)
*H01J 17/20* (2012.01)

(52) U.S. Cl. ..... 313/631; 313/632; 313/623; 445/22

(58) Field of Classification Search ..... 313/627–643, 313/25, 26.3, 318.01–318.12; 439/226; 425/22, 425/26–27

See application file for complete search history.

(56) References Cited

U.S. PATENT DOCUMENTS 6,211,615 B1 * 4/2001 Altmann et al. ..... 313/631
2002/0074943 A1 * 6/2002 Mehr et al. ..... 313/631
2003/0020403 A1 * 1/2003 Okubo et al. ..... 313/574
2004/0245930 A1 * 12/2004 Tukamoto et al. ..... 313/631
2006/0055329 A1 3/2006 Yamashita et al.
2006/0186808 A1 * 8/2006 Ogino et al. ..... 313/574
2006/0208635 A1 * 9/2006 Lenef et al. ..... 313/567

FOREIGN PATENT DOCUMENTS

JP 2000-231903 A 8/2000
JP 2003-123688 A 4/2003
JP 2005-63817 A 3/2005
JP 2006-79986 A 3/2006
JP 2007-042334 A 2/2007
JP 2007-095327 A 4/2007
JP 2009-211916 A 9/2009
JP 2010-113881 A 5/2010
JP 2010-129375 A 6/2010

OTHER PUBLICATIONS

Certified English Translation of Japanese Office Action issued in corresponding Japanese Application No. 2009-147808.

* cited by examiner

*Primary Examiner* — Tracie Y Green
(74) *Attorney, Agent, or Firm* — Rader, Fishman & Grauer PLLC

(57) ABSTRACT

An extra-high pressure mercury lamp includes an arc tube made of quartz glass. The lamp includes an arc tube portion and sealing portions connected to the arc tube portion, and encloses 0.15 mg/mm$^3$ or more of mercury. A pair of electrodes are disposed face to face in the arc tube. Each electrode has a rod portion and a base end portion. The base end portion of each electrode is embedded in one of the sealing portions. One of the pair of electrodes serves as a cathode and includes a head portion, which has a larger diameter than the rod portion. A cylinder portion is connected to a rear end portion of the head portion. The cylinder portion extends in the axis direction of the electrode and surrounds the rod portion. The cylinder portion has an inner surface separated from the rod portion.

7 Claims, 13 Drawing Sheets

EXTRA HIGH PRESSURE LAMP HAVING A NOVEL ELECTRODE STRUCTURE

CROSS-REFERENCES TO RELATED APPLICATION

This application claims priority from Japanese Patent Application Serial No. 2008-324409 filed Dec. 19, 2008 and Serial No. 2009-147808 filed Jun. 22, 2009, the contents of which are incorporated herein by reference in its entirety.

TECHNICAL FIELD

The invention relates to an extra-high pressure mercury short-arc lamp operating at a mercury vapor pressure of at least 150 atmospheres, for example, an extra-high pressure mercury lamp that is used as a back light of a projector device such as a digital light processor (DLP, registered trademark) with a digital micro-mirror device (DMD, registered trademark).

BACKGROUND OF THE INVENTION

A projector device is expected to illuminate images on a rectangular screen uniformly and with excellent color rendition. For this reason, extra-high pressure mercury lamps are preferred. Extra-high pressure mercury lamps include an arc tube made of quartz glass, enclosing 0.15 mg/mm$^3$ or more of mercury and halogen therein, and a pair of electrodes facing to each other in the arc tube with a distance of 2 mm or less therebetween. The halogen is used mainly to prevent blackening of the arc tube, and inevitably causes a so-called halogen cycle in the arc tube. These discharge lamps are described in Japanese Patent Application Publication Nos. 2005-063817, 2006-079986, and 2000-231903, for example.

Unfortunately, these discharge lamps have disadvantages in that the electrodes used therein are separated from each other only by a short distance and that a large current is required for start up. This often results in deformation of the electrodes due to heat generation and blackening of the arc tube due to evaporation of the electrode materials. In view of these problems, the electrodes have been improved to have a structure that extends the lamp life.

With reference to FIG. 13, an electrode structure of such a discharge lamp will be described below. FIG. 13 is a cross sectional view of a basic structure of an extra-high pressure mercury lamp L2 for alternating current operation, as seen in the direction of a tube axis thereof. In FIG. 13, the lamp L2 includes an arc tube 80 made of quartz glass. The arc tube 80 includes an arc tube portion 81 and rod-like sealing portions 82 extending from both ends of the arc tube portion 81. In the arc tube portion 81, generally cylindrical electrodes 90 composed of tungsten are disposed face to face and each electrode 90 has an electrode rod portion 91 connected at the rear part thereof. Each electrode rod portion 91, also composed of tungsten, is embedded in the opposite sealing portion 82 for holding. Each electrode rod portion 91 is connected to a metal foil (not shown) by welding and to an external lead rod through the foil, so that the electrodes are led to the outside of the arc tube.

The electrode 90 has a head portion 92 with a projection 92A at the front end thereof, the head portion 92 being the main body of the electrode 90 and having a spherical shape. The head portion 92 has a cylindrical barrel portion 93 at the rear end thereof. The barrel portion 93 may be provided with a tungsten coil portion 94 wounded and integrally welded therearound for assisting the lamp L2 start-up. The coil portion 94 heats the front end portion of the electrode during glow discharge when the lamp is operated, and promotes the glow-to-arc transition by increasing the temperature of the end portion.

SUMMARY OF THE INVENTION

Such a discharge lamp is configured so that, at start up, each coil portion 94 is intensively heated, and the generated heat is dissipated through the electrode barrel portion 93 and the electrode rod portion 91 toward the sealing portion 82. The heat at elevated temperature is transferred to the quartz glass of the sealing portion 82, and may deform the quartz glass. The heating is repeated every time the lamp is operated. The heating causes the quartz glass to transform and unevenly changes (increases) the volume of the sealing part of the lamp in the circumferential direction thereof. This causes eccentric stress to the electrode rod portion 91, resulting in deformation thereof.

As a result, the distance between the electrodes initially set in the extra-high pressure mercury lamp is changed, and a lamp voltage is changed, which impairs some of the intended functions of the lamp. For example, a decreased distance between the deformed electrodes and the wall of the arc tube causes blackening of the quartz glass, and thus a rapid drop in illuminance. This eventually decreases the lamp's lifetime.

The present invention is in view of the above situation, and is directed to provide an extra-high pressure mercury lamp that suppresses excess temperature increasements of the quartz glass of the sealing portion, so that the deformation of electrode rod portions is prevented, and the lamp's lifetime is prolonged.

The present invention provides an extra-high pressure mercury lamp, including: an arc tube made of quartz glass, having an arc tube portion and sealing portions connected to the arc tube portion, and enclosing 0.15 mg/mm$^3$ or more of mercury therein; and a pair of electrodes disposed face to face in the arc tube, each electrode having a rod portion with the base end portion thereof embedded in the sealing portion for holding, that is characterized in that one of the pair of electrodes serving as a cathode has a head portion disposed at a front end thereof and having a larger diameter than the diameter of the electrode rod portion; and a cylinder portion connected to a rear end portion of the head portion, the cylinder portion extending in the direction of the axis of the electrode to surround the electrode rod portion and having an inner surface separated from the electrode rod portion.

The cylinder portion preferably has a profile portion in the outer surface thereof.

The profile portion for easy thermionic emission is preferably configured as a groove and/or a through-hole formed in the cylinder portion.

In the extra-high pressure mercury lamp, preferably, the cylinder portion and the head portion of the electrode are integrally formed from a material.

Preferably, the extra-high pressure mercury lamp further includes a support portion in an annular space between the cylinder portion and the rod portion that connects the rod portion and the cylinder portion for supporting the cylinder portion.

At the lamp start-up, the electrode serving as a cathode is heated at the cylinder portion thereof, but the cylinder portion connected to the head portion at the front end thereof is not in contact with the electrode rod portion. Accordingly, the heat generated at the start up is not directly transferred from the cylinder portion to the electrode rod portion. This structure suppresses overheating of the sealing portion where the rod portion is embedded and prevents the transformation of the quartz glass of the sealing portion Therefore, the following problems can be solved; the deformation of the electrode rod portion, the loss in optical transmittance due to the change in the distance between the electrodes, and the blackening of the glass because of the approach of the electrode to the arc tube. As a result, the extra-high pressure mercury lamp's lifetime is prolonged.

BRIEF DESCRIPTION OF DRAWINGS

Other features and advantages of the present extra-high pressure mercury lamp will be apparent from the ensuing description, taken in conjunction with the accompanying drawings, in which.

DESCRIPTION

Figure 1:
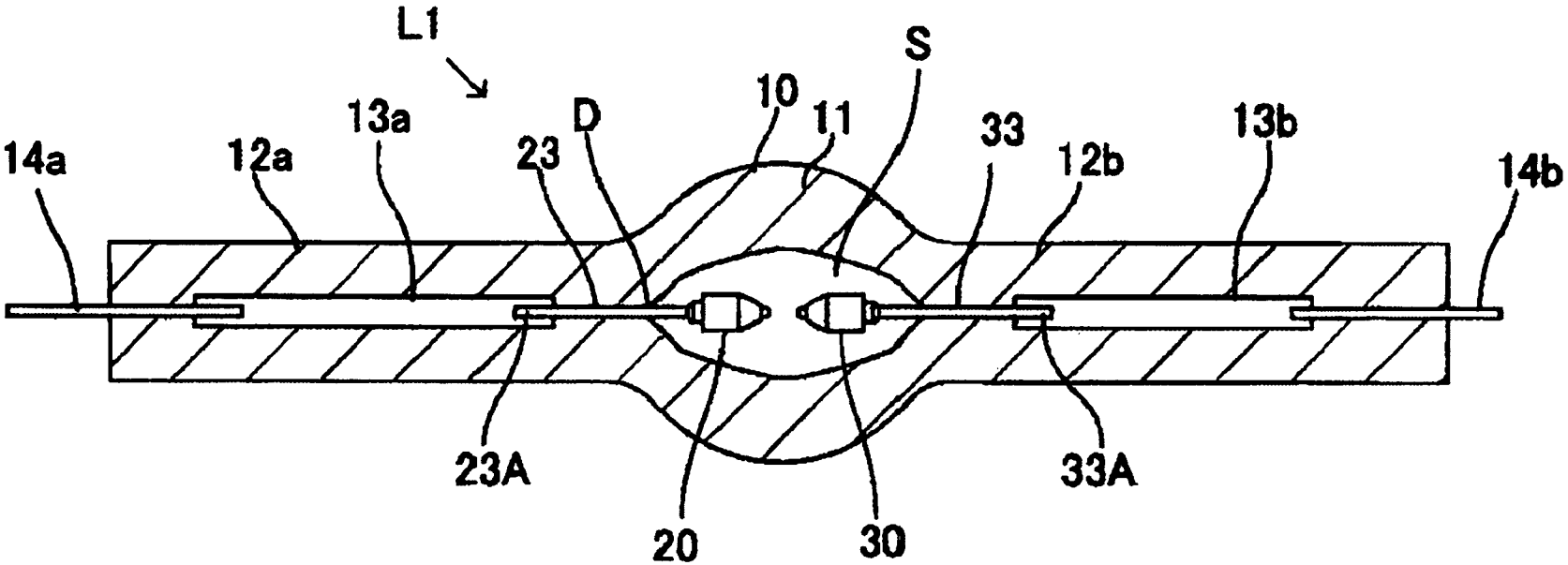
FIG. 1 is a longitudinal cross sectional view illustrating an overall structure of an extra-high pressure mercury lamp according to the present invention.
Figure 2A:
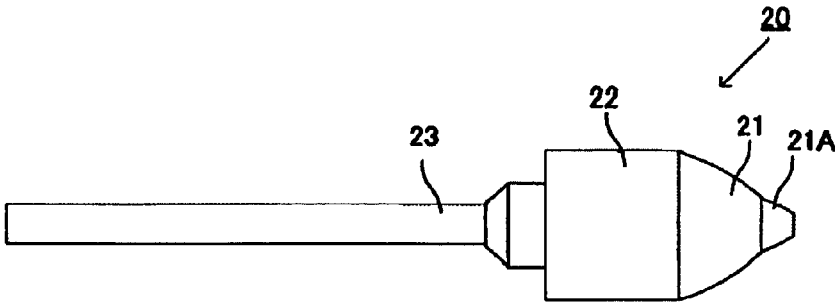
FIG. 2A a side view of an embodiment of an electrode of an extra-high pressure mercury lamp according to the present invention.
Figure 2B:
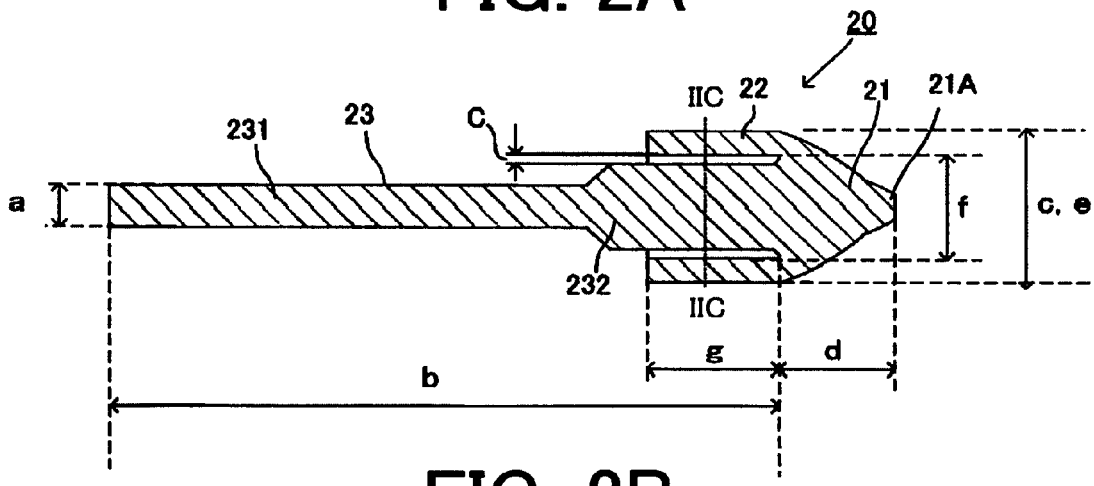
FIG. 2B is an axial cross sectional view thereof.
Figure 2C:
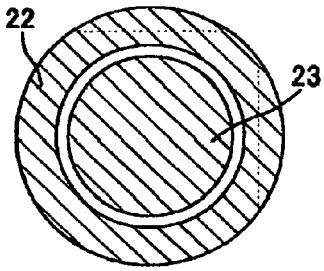
FIG. 2C is a cross sectional view thereof taken along the line IIC-IIC of FIG. 2B.
Figure 3A:
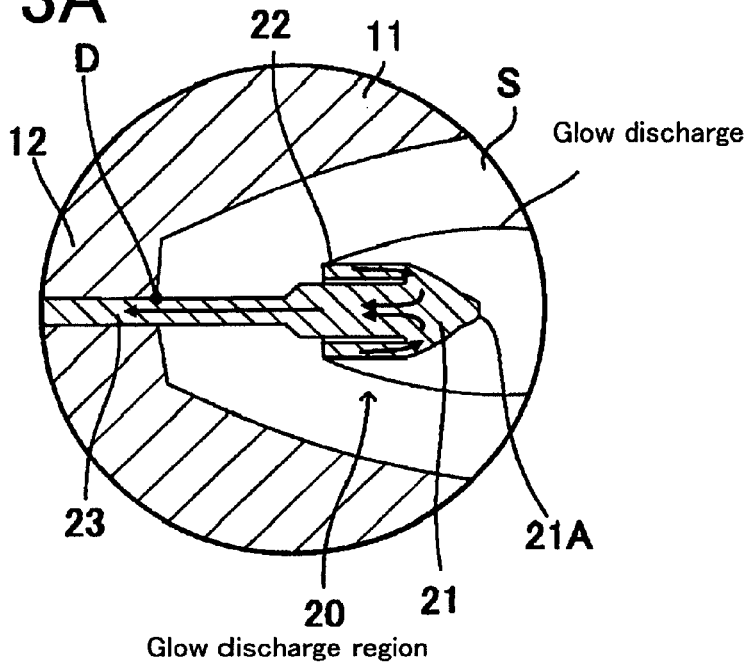
FIGS. 3A and 3B illustrate the operation of the lamp in FIG. 1 at start up.
Figure 3B:
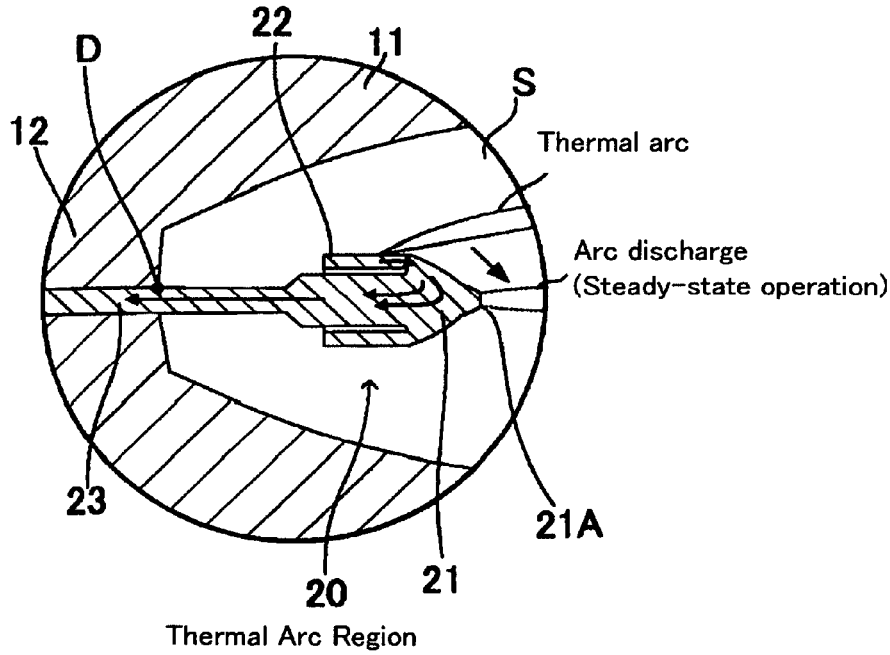

Now, embodiments of the present invention will be described in detail below with reference to FIGS. 1 to 3. FIG. 1 illustrates a longitudinal cross sectional view illustrating an overall structure of an extra-high pressure mercury lamp according to the present invention, taken along the tube axis of the lamp. FIGS. 2A to 2C are enlarged views illustrating an electrode of the extra-high pressure mercury lamp in FIG. 1. FIG. 2A is a side view thereof, FIG. 2B is across sectional view thereof taken along the central axis of the electrode, and FIG. 2C is a cross sectional view thereof taken along the line IIC-IIC of FIG. 2B. FIGS. 3A and 3B illustrate the operation of the lamp in FIG. 1 at start up.

An extra-high pressure mercury lamp L1 (hereinafter, simply referred to as a lamp) includes: an arc tube 10 having a central arc tube portion 11 of a generally spherical shape and rod-like sealing portions 12*a* and 12*b* each extending outwardly from each end of the arc tube portion 11; and a pair of electrodes 20 and 30 disposed face to face in the arc tube portion 11. The sealing portions 12*a* and 12*b* has metallic foils 13*a* and 13*b* embedded therein by shrink seal for example, the foils being molybdenum typically for conduction. The pair of electrodes 20 and 30 respectively have rod portions 23 and 33 electrically connected to ends of the metallic foils 13*a* and 13*b* by welding at base end portion 23A and 33A of the rod portions 23 and 33. The metallic foils 13*a* and 13*b* are connected to external leads 14*a* and 14*b* by welding at the other ends thereof, the leads projecting outwardly from the arc tube 10. The electrodes 20 and 30, including the rearwardly-extending rod portions 23 and 33, are made of tungsten. The extra-high pressure mercury lamp L1 of this embodiment requires an alternating current for steady-state operation, and the electrodes 20 and 30 are configured identically for a more simple design for the steady-state operation.

The arc tube 10 is made of quartz glass. A discharge medium including mercury, a rare gas, and a halogen gas for example is enclosed in the arc tube portion 11 to establish a discharge space S. The mercury is enclosed in at 0.15 $mg/mm^3$ or more for emission of visible light, for example, a light beam having a wavelength within a range of 360 to 780 nm. The amount of mercury should be large enough to be able to achieve a very high vapor pressure of 150 atmospheres or more while the lamp is working. Enclosing more mercury allows a discharge lamp to have a higher mercury vapor pressure of 200 or 300 atmospheres or more. Higher mercury vapor pressure is preferable for a light source suitable to a projector device.

The rare gas is enclosed in at a static pressure of about 10 to 26 kPa, and is, specifically, argon gas used to improve starting performance of the lamp. Halogen gas is enclosed in form of a compound of iodine, bromine, chlorine etc. with mercury and other metals in an amount within a range of $10^{-6}$ to $10^{-2}$ $\mu mol/mm^3$. The halogen compound typically prolongs the lamp's lifetime based on halogen cycles, and also prevents blackening of the arc tube 10 in an extremely small discharge lamp with a high inner pressure (like a lamp of the present invention). Other discharge media, such as metal halide, may be enclosed in the discharge space S.

Specifically, for example, the discharge lamp of the present invention has: the arc tube portion 11 having a maximum outer diameter of 12 mm; the electrodes disposed with a distance of 1.2 mm therebetween; the arc tube 10 having an inner volume of 120 $mm^3$; a rated voltage of 85 V; a rated power input. of 300 W; and an alternating current requirement for operation. Such a discharge lamp is to be incorporated in a projector device that needs to comply with a request for smaller overall dimensions and higher quantity of light. This imposes severe thermal restrictions on the arc tube portion 11, resulting in a tube wall load of 0.8 to 3.0 $W/mm^2$, specifically 2.1 $W/mm^2$. The lamp having such high mercury vapor pressure and a tube wall load provides light emission with excellent color rendering when installed in a presentation device such as a projector.

As illustrated in FIGS. 1 and 2, the electrode 20 serving as a cathode at start up of the lamp in this embodiment includes: a cylindrical electrode rod portion 23; a head portion 21 having a larger diameter than that of the rod portion 23; and a cylinder portion 22 connected to the rear end portion of the head portion 21 outwardly in the axial direction and having a similar diameter to that of the head portion 21. In this embodiment, the rod portion 23 includes: a small diameter portion 231 including the base end portion 23A at the rear end portion thereof and a large diameter portion 232 at the front end portion thereof. The head portion 21 that is connected to the large diameter portion 232 of the rod portion 23 has a maximum outer diameter larger than the diameter of the large diameter portion 232 of the rod portion 23. In this embodiment, the electrode 20 is made of a rod of tungsten, for example, by cutting such as laser processing and electric discharge machining, as a solid single member without a welding joint. The electrode 20 is preferably formed of tungsten of 4 N or more in purity, which reduces an amount of impurity released from the exposed electrode rod portion 23 and head portion 21 into the discharge space S.

Now, the electrode 20 will be described below in detail. As illustrated in FIG. 2, the head portion 21 includes a truncated projection 21A at the front end thereof, the projection having a relatively small diameter. The overall head portion 21 is configured as a generally truncated member with a diameter that increases from one end of a larger diameter of the projection 21A toward the rear end of the head portion 21. The head portion 21 is desirably as small as possible in a balance between the reservation of a volume of the head portion 21 for a sufficient heat capacity to prevent easy melting or evaporation under the heat load of arc discharge and the prevention of blocking the light emitted by the arc (by the electrodes) in the discharge lamp.

The cylinder portion 22 is of a cylindrical shape with a side surface continuous from the portion having the maximum outer diameter of the head portion 21. The cylinder portion 22 has a total length (the depth from the rear end surface thereof) of 1 mm, an outer diameter of 2 mm, and an inner diameter of 1.6 mm (i.e., a thickness of 0.2 mm) at the maximum outer diameter thereof.

As illustrated in FIG. 2, the cylinder portion 22 is disposed to surround the side surface of the rod portion 23 and extends in parallel to the electrode rod portion 23 at a certain distance from the electrode rod portion 23. The cylinder portion 22 needs to have a length to accommodate discharge during glow discharge. If the length is too short, the rod portion 23 may be heated due to the discharge and the distance for the heat transfer from the cylinder portion 22 to the head portion 21 decreases, reducing the function as a temperature barrier for the rod portion 23. Yet, if the length is too long, damage (such as blackening) to the arc tube may occur due to the short distance to the inner wall of the arc tube for the discharge at one end of the cylinder portion 22. From the above viewpoint, practically, the cylinder portion 22 preferably has a total length of 0.3 to 5 mm. In the present invention, the cylinder portion 22 is an axially continuous single member made of tungsten. This allows the cylinder portion 22 to have a self-supporting structure without any problems, such as separation despite an electrode's (20) wear from use. For example, when a coil is used, the coil having a similar cylindrical outer shape but being axially discontinuous, a wire of the coil, when cut, may fall off. The cylinder portion 22 in the present invention is a cylindrical single member of tungsten does not have this problem and can be used repeatedly.

The small diameter portion 232 of the rod portion 23 is designed based specific parameters, such as the rated power consumption of the lamp and the difference in thermal expansion from that of the sealing portion 12*a*. Preferably, the small diameter portion 232 has an outer diameter within a range of from 20 to 70% of that of the maximum outer diameter portion of the head portion 21. When the outer diameter of the electrode rod portion 23 is within the above range it disturbs the heat transfer from the head portion 21 to the electrode rod portion 23, preventing the increase in temperature of the electrode rod portion 23. In this embodiment, the rod portion 23 is configured with the large diameter portion 232 at the front end of the small diameter portion 231. The increase in diameter at the front end of the rod portion 23 (such as using the large diameter portion 232) provides an advantage in that, in manufacture of the electrode 20, a less amount of material is removed by laser processing, for example in forming a gap (C) between the cylinder portion 22 and the rod portion 23. Needless to say, the rod portion 23 could also be formed into a rod-like member having a constant diameter.

The electrode 20 according to the present invention preferably has a gap C between the inner surface of the cylinder portion 22 and the rod portion 23 within a range of 10 μm to 1 mm. This gap provides a heat path via the electrode head portion 21, preventing direct heating of the electrode rod portion 23 even when the temperature of the cylinder portion 22 is elevated at start up of the lamp. This will avoid the transformation of quartz glass at the portion D of the sealing portion 12*a* due to excessive heating of the rod portion 23.

Specifically, referring to FIG. 2, in a configuration described above, the rod portion 23 has a diameter 'a' of 0.4 mm, and a total length 'b' of 5 movement. In the head portion 21, the maximum outer diameter portion has a diameter 'c' of 2 mm, and a total length 'd' of 1.5 movement, whereas in the cylinder portion 22, the maximum outer diameter portion has a diameter 'e' of 2 mm, a maximum inner diameter has a diameter 'f' of 1.2 mm, and a total length 'g' of 1 mm.

The start-up operation of the extra-high pressure mercury lamp L1 of this embodiment will be described below with reference to FIG. 3. The operation is based on the start up in AC phase. FIGS. 3A and 3B are cross sectional views illustrating the portion around the border D between the arc tube portion 11 of the lamp L1 and the sealing portion in FIG. 1. Throughout FIGS. 3A and 3B, the same portions as those described in FIGS. 1 and 2 are designated by the same reference numerals, which will not be described below.

(1) Mercury Arc Region

A high voltage at a high frequency is applied from a power source for set-up (not illustrated), which breaks down the insulation between the electrodes. Then, the electrode 20, which is a cathode in AC phase, releases mercury from the surface thereof to start the mercury arc discharge at several tens of voltages. During the mercury arc discharge, the mercury on the electrode 20 is heated and evaporated. The electrode is not heated enough for thermionic emission in the mercury arc phase. After the complete evaporation of the mercury attached to the cathode electrode, a glow discharge at hundreds of voltages is started.

(2) Glow Discharge Region (FIG. 3A)

When glow discharge occurs, ions of the rare gas, mercury, and tungsten of the electrode material in the discharge space are accelerated by a high voltage at about several hundreds of volts, and the cathode gains energy through its collision with the ions. In the glow discharge phase, the voltage applied is higher than that in the arc discharge current with a lower current density, but current supply can be achieved by the increased cross sectional area. Accordingly, the glow discharge is featured by the region covering the entire surface of the cathode as illustrated in FIG. 3A. The cylinder portion 22, which is thin and has a low heat capacity, is heated to an elevated temperature during the glow discharge. In the electrode 20 according to the present invention, the inner surface of the cylinder portion 22 is disposed separated from the rod portion 23, and is connected only to the head portion 21. Thus, the heat of the cylinder portion 22 is transferred to the head portion 21, and heats the head portion 21 to an elevated temperature.

(3) Thermal Arc Region (FIG. 3B)

Next, arc discharge occurs at a lamp voltage of several tens of volts when the electrode 20 is heated to a temperature that allows the release of electrons. The arc discharge occurs at the position heated to a maximum temperature on the electrode 20, for example, the position on the outer surface of the cylinder portion 22 illustrated by the solid line in FIG. 3B. The position moves closer to the opposite electrode, eventually stops at the tip projection 21A as illustrated by the dashed line.

In the discharge lamp of the present invention, even when the cylinder portion 22 is heated during glow discharge to an elevated temperature, the heat is transferred to the head portion 21, not directly to the electrode rod portion 23. In other words and the separation between the cylinder portion 22 and the electrode rod portion 23 produces the heat path extending therebetween and prevents the rod portion 23 from being subjected heat at start up. Accordingly, excessive heating of the rod portion 23 can be prevented, resulting in a moderate temperature increase at the base end portion of the electrode rod portion 23 embedded in the sealing portion 12.

The above lamp structure described with reference to FIGS. 1 to 3 is one preferred discharge structure for uniform heat transfer to the electrode axis three-dimensionally in all directions. The electrode of the present invention, however, is not limited to the structure, and any similar structure can have the functions and effect of the present invention. The effect of the present invention can be achieved by the structure of an electrode having a cross section that looks like an arrow, as schematically illustrated in the cross sectional view in the axial direction in FIG. 2B. Specifically, for example, the thickness of the cylinder portion between the rear end portion thereof and the head portion does not need to be uniform and may vary. The thickness also may vary in the circumferential direction, too. In addition, the cylinder portion is not limited to a cylinder, but may have a shape with angles at the inner and/or outer surface, or a prismatic shape. The essential point in the structure is that a relatively large portion of the electrode (except the front end) is heated at start-up of the lamp, but then that heat is transferred via the head portion at the front end to the rod portion.

The above structure suppresses the heat transfer from the cylinder portion 22 to the electrode rod portion 23 of the electrode 20, prevents excessive heating and deformation caused by the heating of the electrode rod portion 23, and prevents excessive heating of the quartz glass of the sealing portion 12*a* where the electrode rod portion 23 is embedded. As a result, transformation of the quartz glass and thus a change in volume of the quartz glass is prevented. Consequently, no expansion of the quartz glass of the sealing part of the arc tube 10 occurs that deforms the electrode rod portion 23 and bends the electrode 20.

According to the present invention, the electrode rod portion does not bend, and the distance between the electrodes is not significantly changed. This avoids blackening of the quartz glass of the arc tube and a rapid drop of illuminance: both being caused by a failed lamp function due to a rapid change in a lamp voltage from start-up of the lamp or a shortened distance between the electrode and the wall of the arc tube. As a result, an extra-high pressure mercury lamp has a higher illuminance maintenance factor and a longer lifetime. In the above description, the extra-high pressure mercury lamp (FIG. 1) requiring an alternating current for steady-state operation was used, but an extra-high pressure mercury lamp of direct-current type operates similarly at start up, and thereby the present invention can be applied to an extra-high pressure mercury lamp operated with a direct current. The electrodes in the following embodiments also can be applied to both of these lamp types. The electrodes in a lamp requiring an alternating current for steady-state operation preferably have an identical configuration for equal thermal design, but may have different configurations as long as the electrodes each have a cylinder portion. In the case that one of the electrodes is determined to serve as a cathode at start up, the present invention may be applied only to that electrode.

In the above described extra-high pressure mercury lamp, at start up of the lamp, arc discharge occurs locally at a point on the surface of an electrode for cathode in the glow-to-arc transition when the temperature of the point is elevated enough for arc discharge. Typically, such a heated point for arc discharge does not appear on a smooth surface. Accordingly, a pre-formation of a starting point for arc discharge in the outer surface of the cylinder portion is effective for a rapid glow-to-arc transition and for smooth arc movement toward the projection of a head portion. The starting point is preferably a profile portion in the outer surface of the cylinder portion. Now, an embodiment having a profile portion is described below with reference to FIGS. 4 to 8.

FIGS. 4 to 8 each illustrate a configuration of an electrode for embodiments of an extra-high pressure mercury lamp according to the present invention. Throughout FIGS. 4 to 8, the same portions as those described in FIGS. 1 to 3 are designated by the same reference numerals, which will not be described below. FIGS. 4 to 8 each illustrate a front end of an electrode for cathode, the other configurations of the lamp in these embodiments being similar to those of the above embodiment.

Figure 4B:
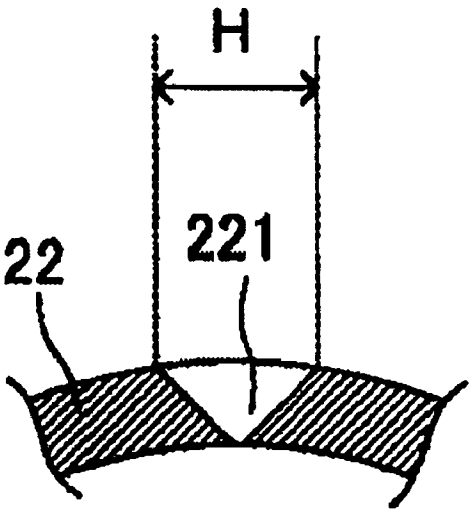
FIGS. 4A and 4B illustrate an embodiment of the electrode in an extra-high pressure mercury lamp according to the present invention.
Figure 4A:
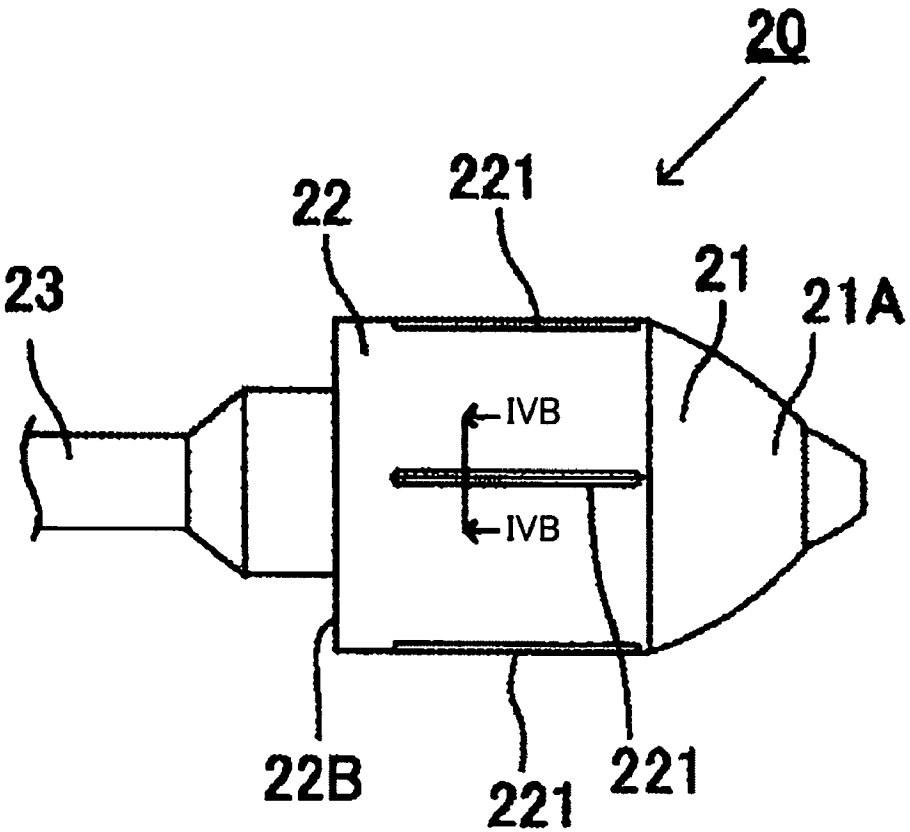

The cylinder portion 22 illustrated in FIG. 4A has four grooves 221 formed in the outer surface thereof in the axial direction of the electrode. The plural grooves 221 are circumferentially spaced at equal intervals. As seen from FIG. 4B, the grooves 221 have a V-shaped cross section, but are not restricted to just a V-shape. During glow discharge, the edge portion of each of the grooves 221 adjacent to the outer surface is heated to elevated temperature, which helps the emission of thermo-electrons, and thus the glow-to-arc transition. The grooves 221 each have a width of 0.5 mm or less, for example, desirably 0.2 mm or less, and an adequate depth without a lower limit. The thermo-electrons are emitted between the walls of tungsten of the grooves 221, and induced by discharge toward the opposite electrode for anode. In this embodiment, the grooves 221 extend toward the head portion parallel to the axis of the electrode, promoting the smooth movement of the electrons to the head portion 21 and the projection 21A. With use of such grooves extending generally parallel to the axis of the electrode, most of the thermo-electrons are generated in the grooves. This facilitates the estimation of a discharge position and a better lamp design.

The grooves 221 of this embodiment may further extend to be open at the rear surface 22B of the cylinder portion 22 with an appropriate width of an opening. In addition, the grooves 221 may be separated at random intervals from each other. Furthermore, a single groove 221 instead of the plural grooves 221 is enough for the above effect.

Figure 5B:
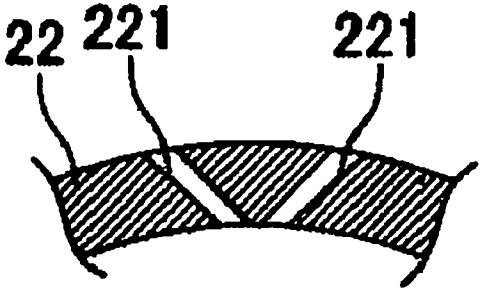
FIGS. 5A and 5B illustrate an embodiment of the electrode in an extra-high pressure mercury lamp according to the present invention.
Figure 5A:
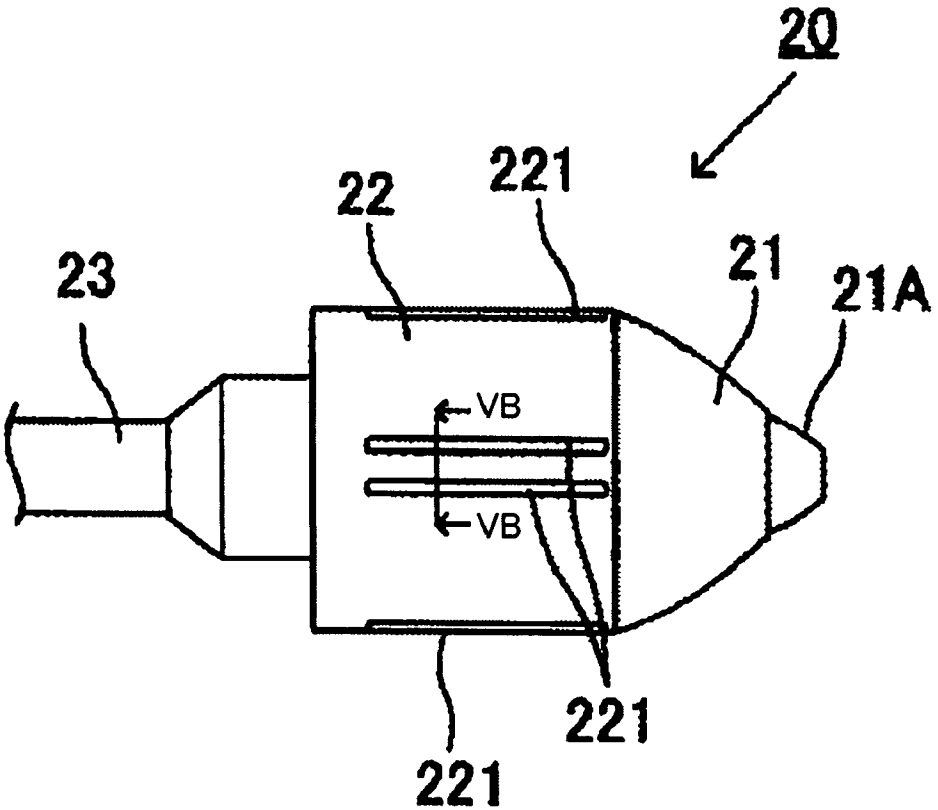

Another embodiment is now described with reference to FIG. 5. In this embodiment, similar to the above embodiment, the cylinder portion 22 has plural pairs of grooves 221 arranged in parallel in the axial direction of the electrode. The narrow grooves of one pair are spaced at a certain interval, and have a depth in the thickness of the cylinder portion 22 in the directions intersecting each other to form an angle therebetween relative to the outer surface of the cylinder portion 22. The intersection of the grooves creates sharp edge portions and smaller thickness portions at the outer surface of the cylinder portion 22. This facilitates temperature elevation, and reduces the energy for a glow-to-arc transition.

Figure 6A:
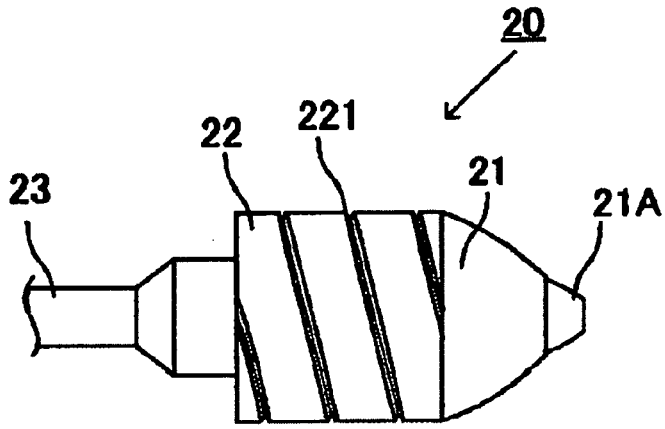
FIGS. 6A to 6C are side views illustrating embodiments of the electrode in an extra-high pressure mercury lamp according to the present invention.
Figure 6B:
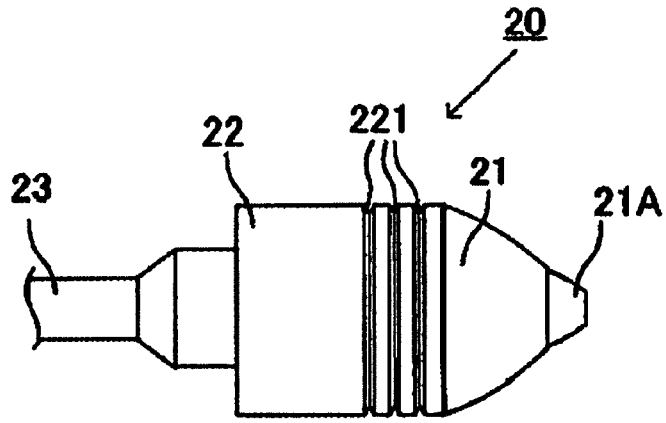

Another embodiment is now described. The electrodes of the above embodiments illustrated in FIGS. 1 to 5 have grooves parallel to the axis of the electrode, but the grooves may have other configurations. For example, the grooves may be a continuous spiral as illustrated in FIG. 6A, or circumferentially extend (in the direction orthogonal to the axis of the electrode) as illustrated in FIG. 6B. Such a continuous groove around the cylinder portion does not impose a limit on the point where arc occurs. This provides an advantage in that intensive blackening of the arc tube portion 11 is prevented in case of sputtering of the electrode.

Figure 6C:
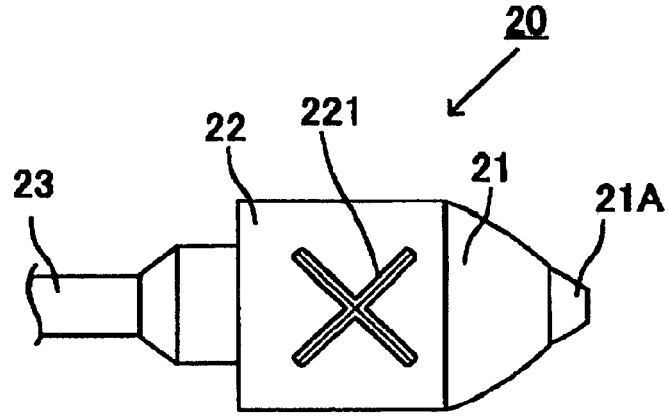

The grooves may have a crossed configuration as illustrated in FIG. 6C. The grooves have a central crossed portion with edges that facilitates the emission of thermo-electrons and provides an advantage of better starting performance. The number of the grooves and the angle defined by the crossed grooves may be chosen as desired.

Figure 7A:
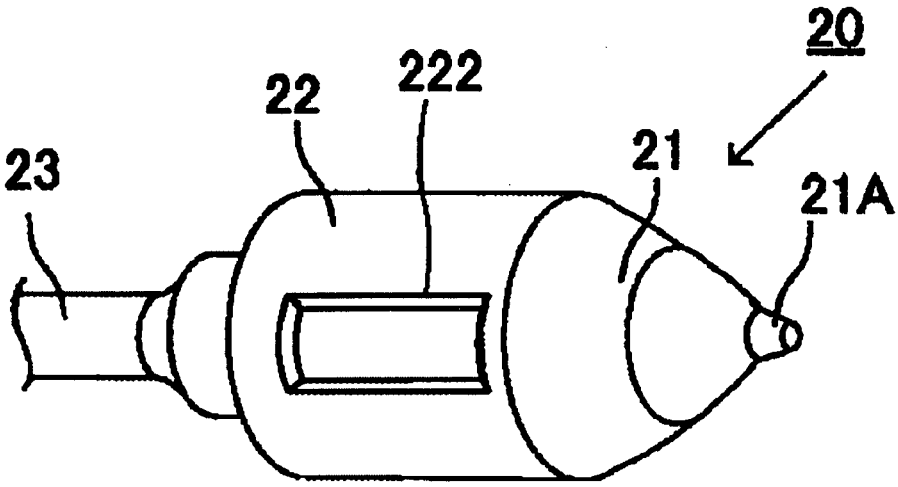
FIGS. 7A and 7B illustrate embodiments of the electrode in an extra-high pressure mercury lamp according to the present invention.

In the above embodiments, grooves are used as the profile portion for easy emission of thermo-electrons in the cylinder portion, but the profile portion is not limited to the grooves, and at least a part of the profile portion may be through the thickness of the cylinder portion. For example, FIG. 7A illustrates a generally rectangular through-hole 222 formed in the cylinder portion 22. Based on the through-hole 222, as a profile portion, Edge portions of the through-hole 222 between the outer surface and inner surface of the cylinder portion 22 have a highest current density during arc transition, and are locally heated as a portion for thermionic emission.

Figure 7B:
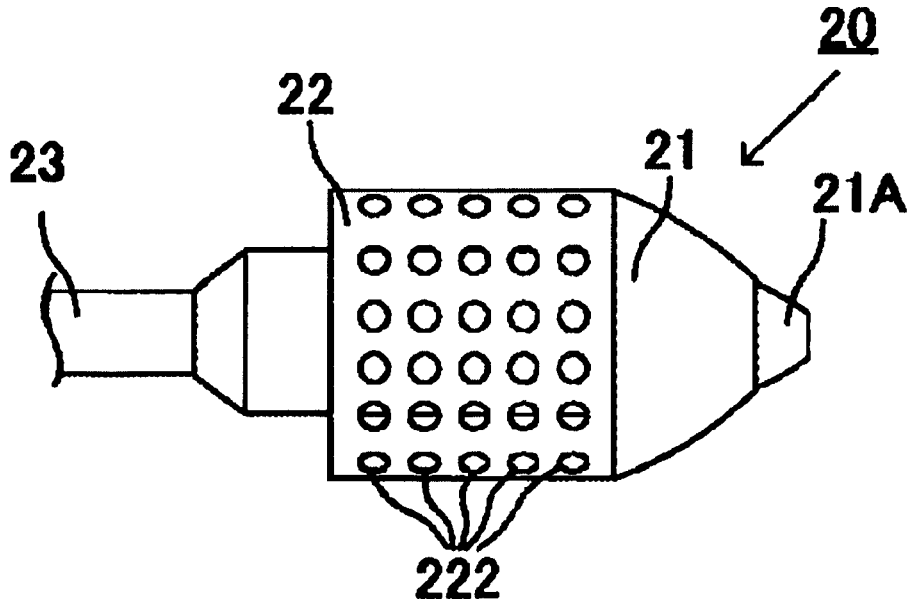

FIG. 7B illustrates circular through-holes as another configuration of a through-hole in the cylinder portion 22. As described above, the through-hole 222 areas have the highest current density for arc discharge at the edge portions, which may produce uneven distribution of thermal energy. The circular through-holes (or groove) as illustrated in FIG. 7B are not unevenly and excessively heated along the edges, preventing a local melting of the electrode in a glow-to-arc transition. In addition, a high spatial electron density can be obtained due to the presence of the electrode around the center of each hole, which effectively gives a hollow effect, and improves the starting performance. The same effect can be obtained by configurations other than the through holes as long as the holes are circular, and the holes do not go through the thickness. Examinations of the relationship between starting performance and current resistance have demonstrated that the circular holes each preferably have an inner diameter of 0.01 to 1 mm, more preferably of 0.05 to 0.5 mm. From the viewpoint of starting performance, the inner diameter is most desirably 0.1 mm, but is desirably 0.2 to 0.3 mm when current resistance is taken in consideration.

At least one through-hole 222 (or groove) is provided, and the number of the through-hole 222 can be increased as necessary. Plural through-holes 222 (or grooves) can keep the profile desirable even when the lamp is worn out or decayed after repeated start-up operations, and thus provide stable starting performance up to the last period of the lamp. This increases the reliability on starting performance. The plural profile portions such as the through-holes 222 (or grooves) are preferably arranged symmetrically around the axis of the electrode.

In the above embodiments, the profile portions are formed by cutting the cylinder portion itself. According to the above embodiments, the machining of the surface of the electrode body advantageously improves the starting performance of the lamp as compared to the lamp without any machining. Using a coil for start up, as is known in the art, results in grain growth of tungsten of the coil, and the coil sometimes breaks and falls off due to the grain boundary fracture of tungsten. The above embodiments do not use a coil, eliminating any means for preventing this defect.

Figure 8A:
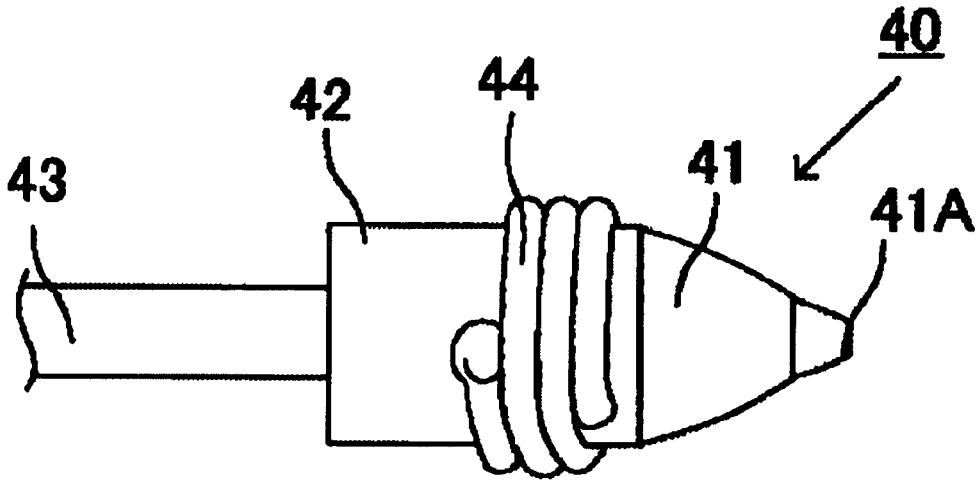
FIG. 8A is a side view of an embodiment of the electrode in an extra-high pressure mercury lamp according to the present invention.
Figure 8B:
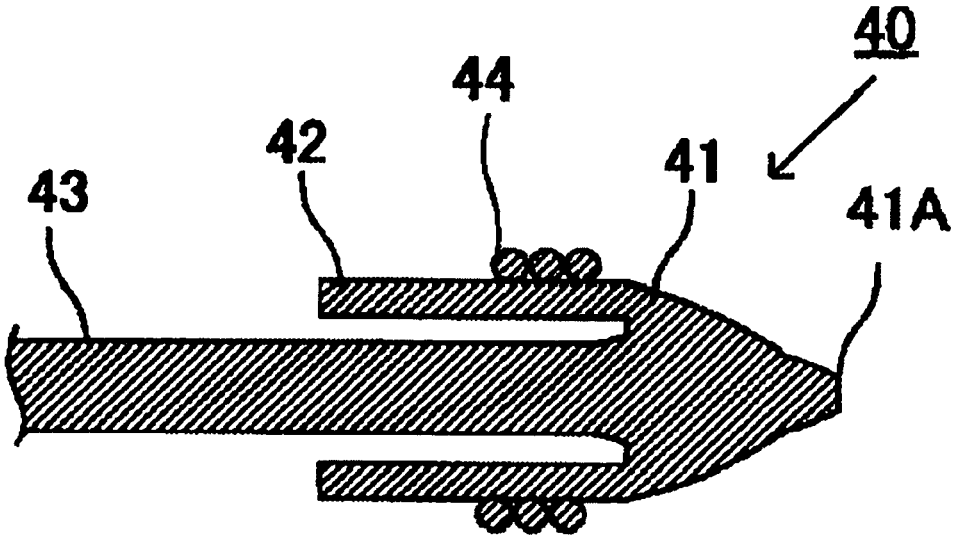
FIG. 8B is a cross sectional view thereof.

In addition to the above profile portions, a profile portion in the cylinder portion can be obtained by winding a tungsten wire around the cylinder portion into a coil, as in the conventional structure. This case gives starting performance similar to the conventional electrode having a coil, resulting in excellent reliability at start up. This embodiment is described below with reference to FIGS. 8A and 8B. FIG. 8A is a side view of an electrode, whereas FIG. 8B is a longitudinal cross section of the electrode. An electrode 40 includes a truncated head portion 41 having a projection 41A at the front end thereof, a cylinder portion 42 connected to the rear end of the head portion 41, and a rod portion 43 centrally connected to the rear end surface of the head portion 41 and extending rearwardly. The rod portion 43 of this embodiment is a cylinder having a constant diameter. The cylinder portion 42 is not in contact with the outer surface of the rod portion 43, and is only connected to the head portion 41 at one end thereof. A tungsten wire 44 is wound around the outer surface of the cylinder portion 42, and the ends of the wire are integrated with the cylinder portion 42 by welding.

Specifically, in the electrode illustrated in FIG. 8, the electrode head portion 41 has a maximum diameter of 1.0 to 2.2 mm, the rod portion has a diameter of 0.3 to 1.0 mm, and the cylinder portion has an outer diameter of 1.0 to 2.2 mm and an inner diameter of 0.8 to 2.0 mm. The cylinder portion 42 is separated from the rod portion 43 by a distance of 10 μm to 1 mm, and has a total length of 0.5 to 5 mm. The tungsten wire has a diameter of 0.1 to 0.3 mm, and is wound 1 to 10 turns therearound.

As described above, a coiled profile portion can be provided around the outer surface of the electrode cylinder portion for the spot for emission of thermo-electrons.

In each case of the profile portions in an electrode surface described above with reference to FIGS. 4 to 8, the profile portion is preferably provided close to the electrode head portion. Therefore, a thermionic emission closer to the electrode head portion facilitates the movement of an arc to the projection after the arc discharge occurs.

Figure 9A:
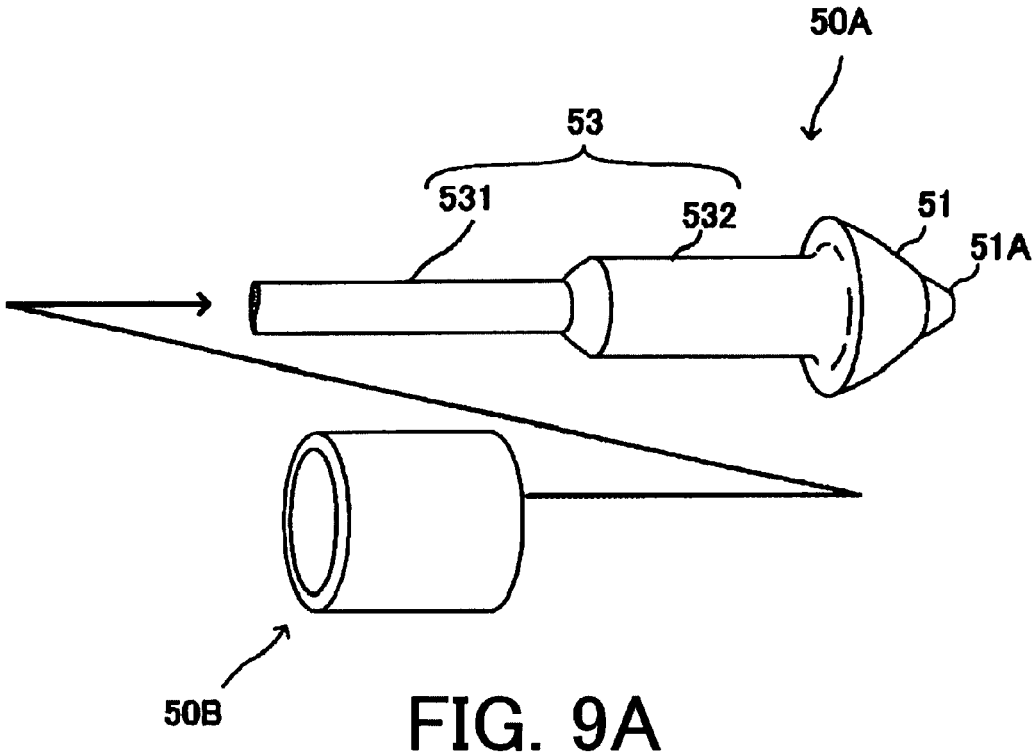
FIG. 9A illustrates a step for assembling an electrode according to the present invention.
Figure 9B:
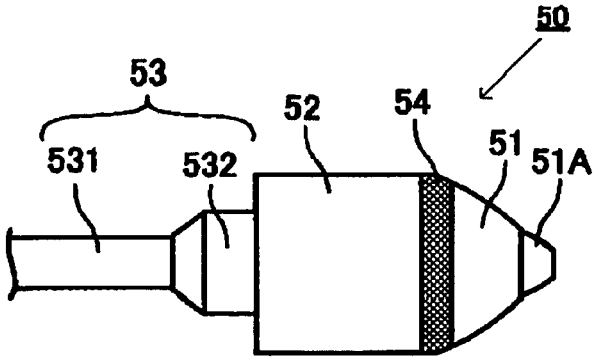
FIG. 9B is a side view illustrating the assembled electrode.

The electrode used in an extra-high pressure mercury lamp of the present invention may be a single member formed by cutting a material or a rod of tungsten. Alternatively, the electrode may be formed, for example, by welding plural members. The latter case is described below with reference to FIGS. 9A and 9B. FIG. 9A illustrates a step for assembling members of an electrode according to the present invention, and FIG. 9B is a side view illustrating the assembled electrode. In FIG. 9A, an electrode 50 includes a head portion 51 having a projection 51A at the front end thereof and a rod portion 53 integrally formed at the center of the rear surface of the head portion 51 and extending in the axial direction rearwardly. The rod portion 53 includes a large diameter portion 532 connected to the head portion 51, and a small diameter portion 531 connected to the large diameter portion 532. The structure 51A with the head portion 51 and the rod portion 53 can be made by cutting a rod of tungsten. A cylinder material 50B for a cylinder portion is a barrel of tungsten having outer and inner diameters adapted to the outer diameter of the rear end of the head portion. The cylinder material 50B can be made by cutting a tube of tungsten in a length of the total length of the cylinder portion, for example. The electrode 50 is assembled by inserting the rod portion of the structure body 50A into the cylinder portion 50B, so that one end surface of the cylinder material 50B is coaxially secured to the rear end surface of the head portion 51, and the interface between the surfaces is bonded by welding for assembly. This results in the electrode 50 having the cylinder portion 52 as illustrated in FIG. 9B. The welding 54 is made for bonding as illustrated in FIG. 9B. The welding between the cylinder portion 52 and the head portion 51 for assembly also promotes the heat transfer to the head portion 51 during glow discharge at start up of the lamp.

In the case that the electrode 50 has a profile portion in the outer surface of the cylinder portion 52, the profile portion may be formed by laser processing, for example after the assembly by welding.

Figure 10A:
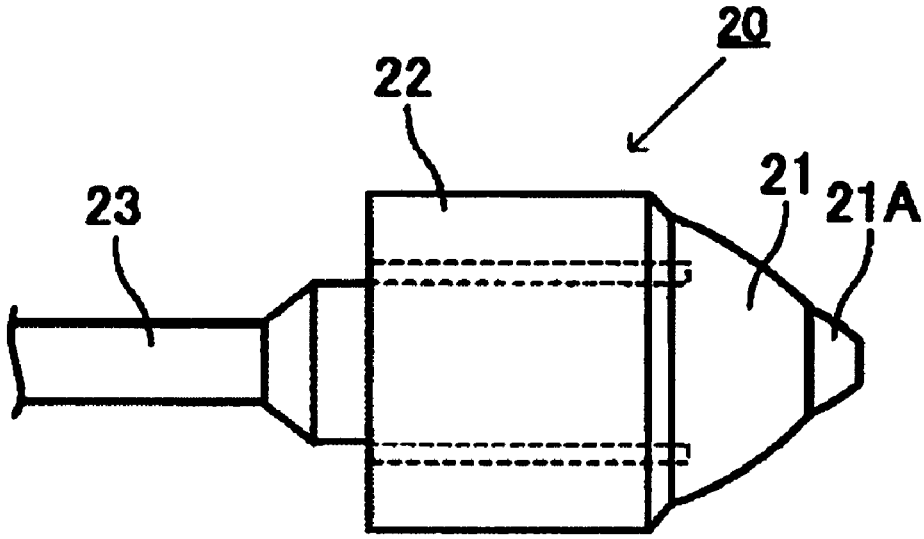
FIGS. 10A and 10B are side views illustrating embodiments of the electrode in an extra-high pressure mercury lamp according to the present invention.
Figure 10B:
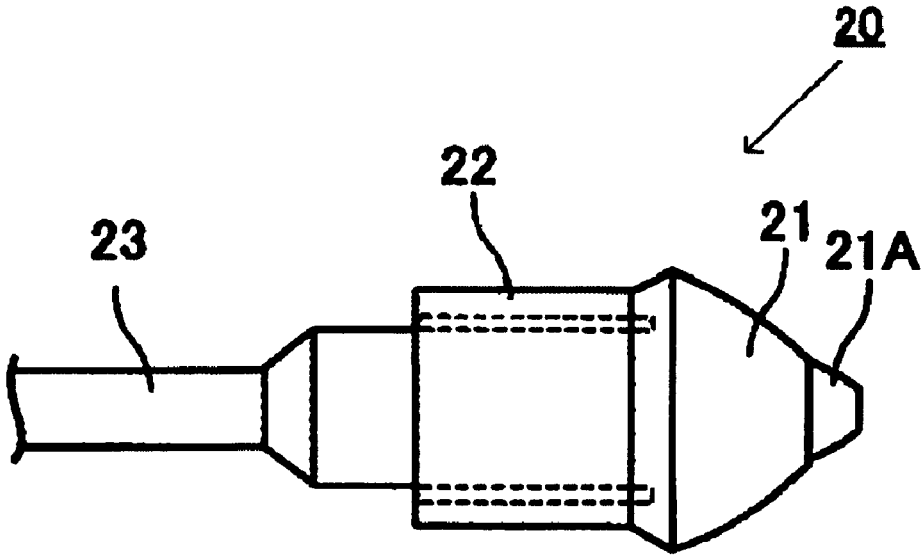

In the present invention, the head portion 22 and the cylinder portion 21 may have different outer diameters at the interface therebetween. For example, as illustrated in FIGS. 10A and 10B, the head portion 22 and the cylinder portion 21 may provide a stepped structure. FIGS. 10A and 10B are side views of electrodes of embodiments according to the present invention, the same portions as those in FIGS. 1 to 3 being designated with the same reference numerals. In FIGS. 10A and 10B, between the cylinder portion 21 and the rod portion 23, there is a gap illustrated by the imaginary dashed line. As illustrated, the head portion 22 may have a larger diameter than that of the cylinder portion 21, and vice versa. Alternatively, the structure may have progressively decreasing diameters to be tapered (not shown).

Figure 11A:
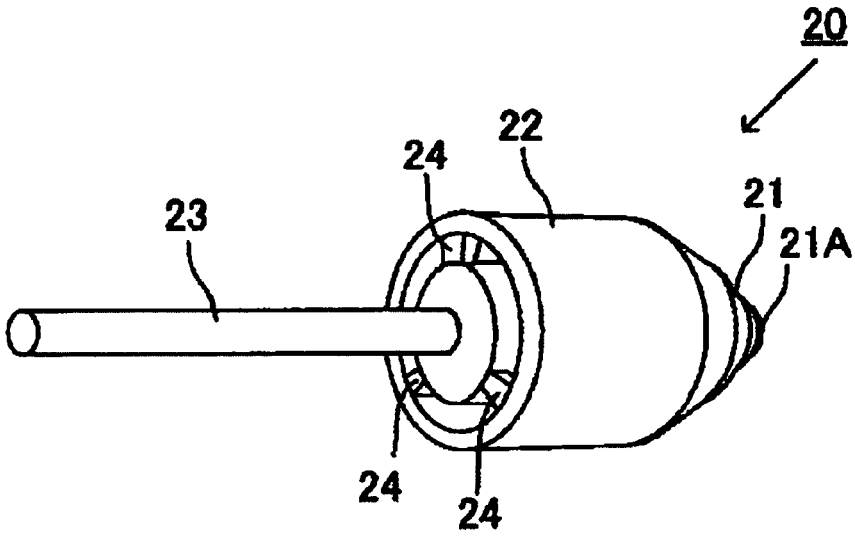
FIG. 11A illustrates an embodiment of the electrode in an extra-high pressure mercury lamp according to the present invention, with FIG. 11B being a cross sectional view thereof taken along the center axis.
Figure 11B:
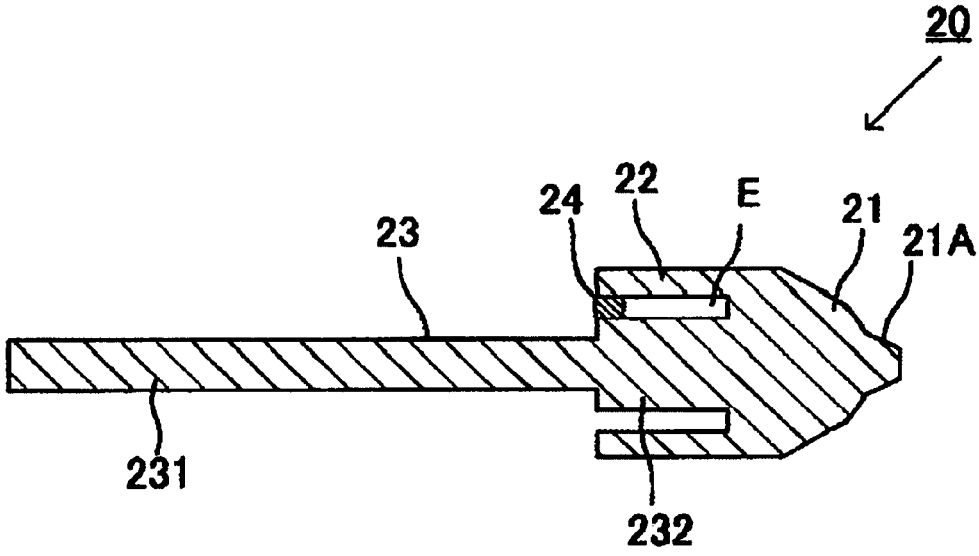

A further embodiment of the present invention will be described below. FIG. 11A is a perspective view of an electrode as seen from the rear side thereof, whereas FIG. 11B is an axial cross sectional view of the electrode, the same portions as those in FIGS. 1 to 3 being designated with the same reference numerals. As described above, in an extra-high pressure mercury lamp according to the present invention, using a structure of the electrode 20 that suppresses the heat transfer from the cylinder portion 22 to the electrode rod portion 23 prevents the direct heat transfer from the electrode rod portion 23 to the sealing portion, and avoids the excessive heating of the quartz glass where the electrode rod portion 23 is embedded. In an extra-high pressure mercury lamp according to the present invention, however, the electrode including the cylinder portion 22 is exposed to heating at elevated temperature at the front end of the rod portion 23 (i.e., at the connection with the head portion). The rod portion 23 having an extremely small diameter of less than 1 mm for example cannot support the weight of the head portion 21 and the cylinder portion 22 at the portion thereof close to the head portion 21, and tends to be deformed. Particularly when the lamp is used such that the arc tube is supported in a direction that keeps the electrode axis horizontal, the rod portion 23 needs to support the weight of the head portion 21 and the cylinder portion 22. If the rod portion 23 is deformed by the weight, stress is concentrated on the deformed portion, which may lead to bending of the rod portion 23. This is likely to occur to the cathode electrode (at start up) during the last period of the lamp. In an extra-high pressure mercury lamp of this embodiment, as illustrated in FIGS. 11A and 11B, at least one support portion 24 is provided in the annular space between the cylinder portion 22 and the rod portion 23 to connect the cylinder portion 22 to the rod portion 23. The support portion 24 compensates for the insufficient strength of the rod portion 23 during the last period of the lamp. Even if the rod portion 23 is partly deformed, the support portion 24 prevents concentration of stress on the deformed portion, and avoids bending of the rod portion 23. This further prolongs the lamp's lifetime.

This embodiment will be described below in detail. In the embodiment illustrated in FIG. 11A, three support portions 24 are provided coplanar with the rear end surface of the cylinder portion 23 at equal intervals from one another. The plural support portions 24 at equal intervals provide mechanical strength uniformly in the circumferential direction of the electrode 20. The electrode 20 having the support portions 24 may be made by preparing the electrode 20 having head portion 21, the cylinder portion 22, and the rod portion 23, and then forming the support portions 24 in the gap between the cylinder portion 22 and the rod portion 23 by laser welding, with space 'E' being left in front of each of the support portions 24 in the cylinder portion 22. Alternatively, the electrode 20 may be made by cutting a single rod of tungsten to form a discharge electrode, and then forming the support portions 24 in the electrode by electric discharge machining. In other words, one electrode member may be used to form spaces between the cylinder portion 22 and the rod portion 23 so that the narrow support portions 24 are left between the spaces.

The support portions 24 are desirably provided only at the rear end portion of the cylinder portion 22 with the space E being left in front of each of the support portions 24 for reduction in the heat transferred from the cylinder portion 22 to the rod portion 23. From the viewpoint of machining, however, it is sometimes difficult to leave the spaces E between the support portions 24 and the head portion 21. In this case, the support portions 24 may be ribs continuously elongated along the entire length of the cylinder portion 22. In either case, as the amount of contact between the cylinder portion 22 and the rod portion 23 is increased, the amount of heat transferred to the rod portion 23 is increased. Accordingly, the balance between the amount of contact should be considered when increasing mechanical strength and prolonging lamp lifetime. To obtain an electrode having the effect of the present invention, desirably, the support portions 24 is as small as possible while compensating for the strength of the rod portion 23. Needless to say, the electrode having the support portions 24 may have a profile portion in the cylinder portion in the form of a groove or a through-hole for example. The electrode with this profile portion provides further start-up performance reliability.

In the electrode 20 configured as described above, heat transfer from the cylinder portion 22 to the rod portion 23 is suppressed, excessive heating of the rod portion 23 is prevented, deformation and bending of the rod portion 23 by heat is prevented, and bending of the rod portion 23 is prevented by a structure for distributing the weight applied to the rod portion 23 even when the fatigue of the electrode is accumulated during the last period of the lamp. As a result, an extra-high pressure mercury lamp having a further prolonged lifetime is provided.

Various configurations of the electrode of the present invention have been described with reference to the drawings, but the present invention is not limited to the drawings. In an extra-high pressure mercury lamp according to the present invention that requires an alternating current for steady operation, the electrodes preferably have an identical configuration for equal thermal design, but the present invention is effective when an electrode for cathode at start up of the lamp has a cylinder portion. Accordingly, in the case that one of the electrodes is determined to serve as a cathode, a configuration of the present invention is applied only to that electrode. The lamp requiring an alternating current for operation is illustrated in FIG. 1, but needless to say, the present invention is also applicable to an extra-high pressure mercury lamp operated with a direct current.

An example of an extra-high pressure mercury lamp according to the present invention will be described below in detail, but the present invention is not limited to this example.

Electrodes having a configuration similar to that illustrated in FIG. 4 were formed to obtain an extra-high pressure mercury lamp as that illustrated in FIG. 1 except the configuration of the electrodes. The extra-high pressure mercury lamp is specified as follows. The lamp was operated with an alternating current at start up, and the electrodes had an identical configuration.

Lamp Specification

Arc Tube: Material; Quartz Glass, Maximum Outer Diameter of Arc Tube Portion; 12 mm; Total Length; 12 mm, and Inner Volume of Discharge Space; 100 $mm^3$.

Electrode: Material; tungsten, and Total Length; (including head portion and rod portion); 7.0 mm.

Head Portion: Maximum Outer Diameter; 2.0 mm, and Length; 0.2 mm.

Cylinder Portion: Maximum Outer Diameter; 2.0 mm, and Length; 1.0 mm.

Axis Portion: Larger Diameter; 0.8 mm; Smaller Diameter; 0.4 mm, and Length; 4.0 mm.

Distance between Electrodes: 1.4 mm.

Metallic Foils: Material; molybdenum, Length; 15 mm, Width; 2.0 mm, and Thickness; 25 μm.

Enclosed Material: Mercury; 0.2 $mg/mm^3$, Bromine Gas (Halogen); $3.0\times10^{-4}$ $\mu mol/mm^3$, and Argon (Rare Gas); 13 kPa.

Mercury Vapor Pressure at Steady Operation of Lamp: 170 atmospheres or more.

Input Power: 275 W.

Four pairs of grooves, eight grooves in total, were formed in the outer surface of the cylinder portion of the electrode configured as described above, the grooves being parallel to each other at equal intervals therebetween in the circumferential direction of the electrode. Each of the grooves had a width of 50 μm, a depth of 50 μm, and a length of 0.8 mm. The adjacent grooves were separated by a space of 0.1 mm.

COMPARATIVE EXAMPLE

Figure 13:
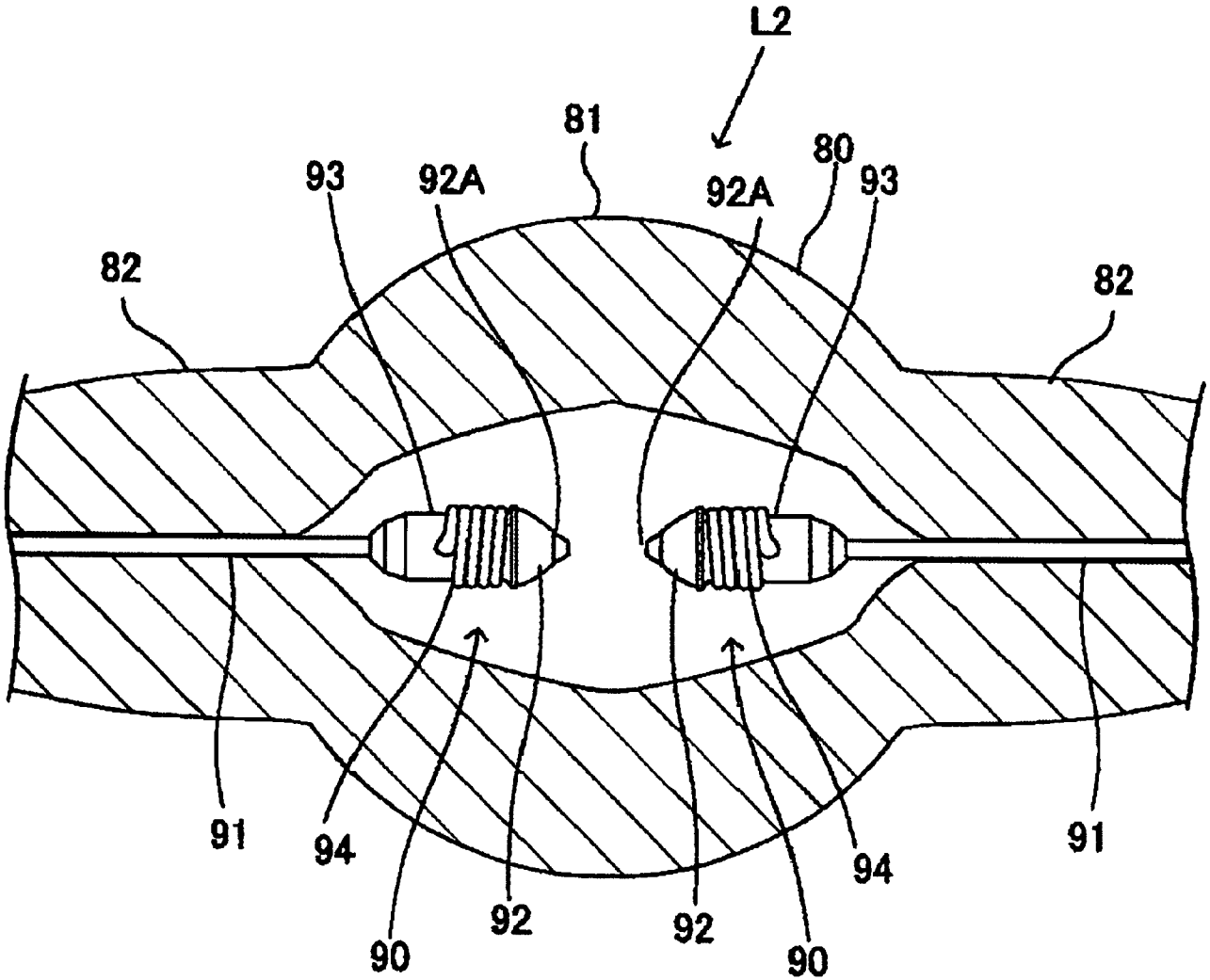
FIG. 13 is an enlarged cross sectional view illustrating main portions of a conventional extra-high pressure mercury lamp.

A comparative extra-high pressure mercury lamp was formed, the lamp being similar to that of Example except that the electrodes had a configuration illustrated in FIG. 13.

An operation test was performed on these extra-high pressure mercury lamps to obtain illuminance maintenance factor data.

Operation Test

Figure 12:
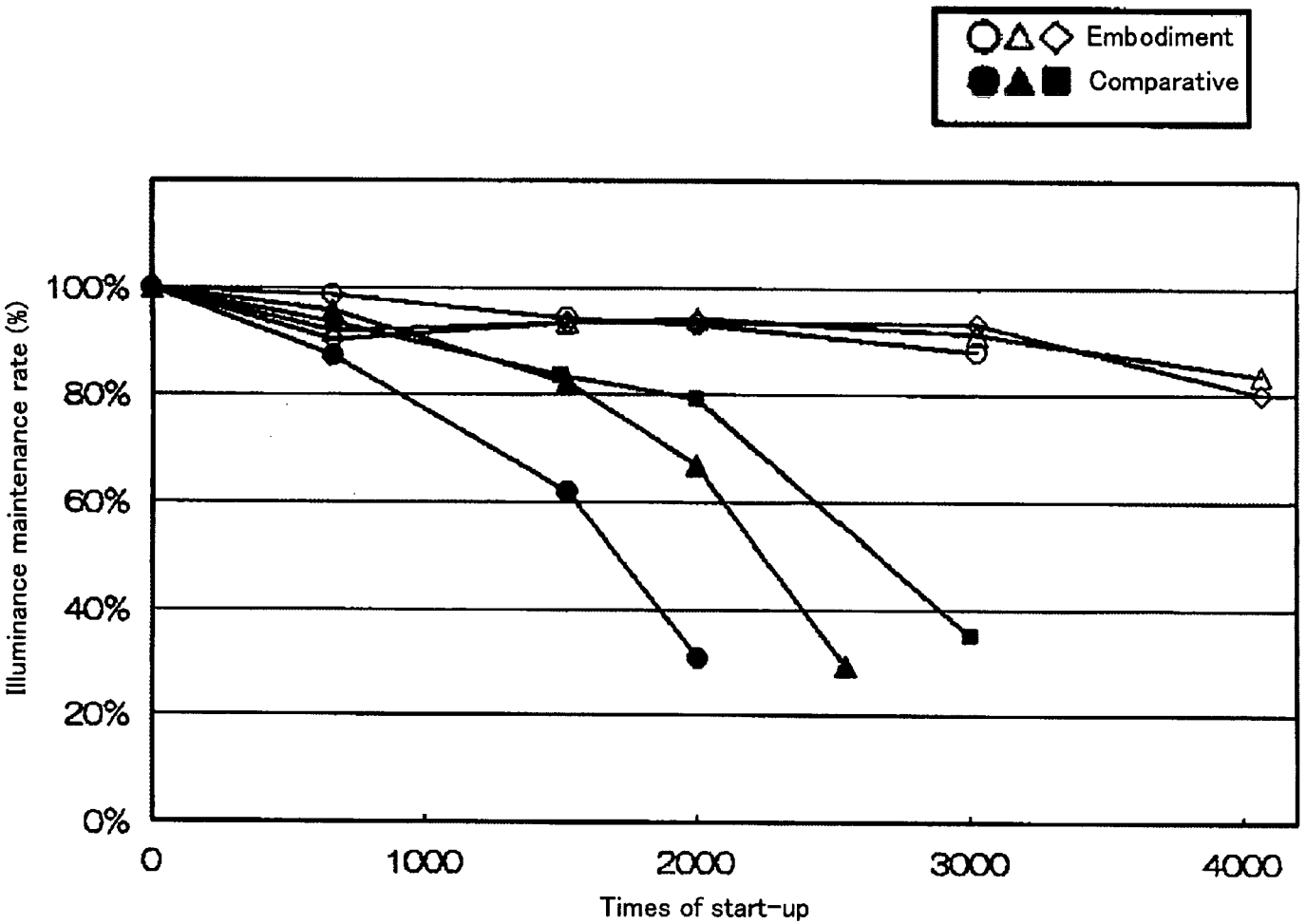
FIG. 12 is a graph showing changes in an illuminance maintenance factors of lamps in process of times of turn on and off, as a percentage of the initial light illuminance at start up of each of the lamps.

An operation test was performed on three extra-high pressure mercury lamps of Example and three extra-high pressure mercury lamp of Comparative Example. The lamps were turned on for five minutes and turned off for five minutes in one cycle, which was repeated. After every 500 cycles of the operation, deformation of the electrode rod portions, if any, was checked under a microscope, and the illuminance of the lamps were measured. The change in an illuminance maintenance factor was measured in process of time as a percentage of the illuminance of the light at an early stage of the lamp operation. The obtained results are shown in FIG. 12.

As the result of the lighting test showed, no bending of the electrodes were observed in the extra-high pressure mercury lamp of Examples, and no sign of crystallization was found in the quartz glass of the sealing portion. The voltage at start up after 4000 times of turning on and off, the increased voltage was less than about 10 V, and there was little change in the distance between the electrodes. To the contrary, in the extra-high pressure mercury lamps of Comparative Example, it depended on the lamps, but the electrodes were deformed and the distance between the electrodes was changed after operation for about 2000 hours, resulting in the increase in voltage at start up of 20 to 40 V, and impairing the starting performance of the lamps.

As seen from the above results, in each of the extra-high pressure mercury lamps of Example, the following was demonstrated: deformation of the rod portion of each electrode was prevented, the observed change in the distance between the electrodes was little, the starting performance was excellent, blackening caused by the approach of electrodes to the arc tube was prevented, the illuminance maintenance factors were high, which prolonged lifetime of the extra-high pressure mercury lamps.

The preceding description has been presented only to illustrate and describe exemplary embodiments of the present extra-high pressure mercury lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. An extra-high pressure mercury lamp, comprising:

a quartz glass arc tube including an arc tube portion and sealing portions connected to the arc tube portion, the arc tube encloses 0.15 $mg/mm^3$ or more of mercury; and a pair of electrodes disposed face to face in the arc tube, each electrode comprises a rod portion and a base end portion, the base end portion is embedded in the sealing portion;

characterized in that, one of the pair of electrodes serves as a cathode and further comprises a head portion and a tube-like portion, the head portion is larger than the rod portion in diameter, the tube-like portion is connected to a rear end portion of the head portion, the tube-like portion extends in an axial direction of the electrode and comprises an inner cylindrical surface separated from the rod portion forming an axially-extending annular gap between the tube-like portion and the rod portion; and the rod portion and the head portion are formed integrally.

2. The extra-high pressure mercury lamp according to claim 1, characterized in that the tube-like portion further comprises a profile portion thereby facilitating thermionic emission.

3. The extra-high pressure mercury lamp according to claim 2, characterized in that the profile portion is a groove, a through-hole, or a groove and through-hole.

4. The extra-high pressure mercury lamp according to claim 1, characterized in that the tube-like portion and the head portion are formed of a same material.

5. The extra-high pressure mercury lamp according to claim 2, further characterized in that a support portion connected to the axis portion at a rear end of the tube-like portion thereby supporting the tube-like portion.

6. The extra-high pressure mercury lamp according to claim 1, further comprising a support portion connected to the rod portion at a rear end of the tube-like portion thereby supporting the tube-like portion.

7. The extra-high pressure mercury lamp according to claim 2, further comprising a support portion connected to the rod portion at a rear end of the tube-like portion thereby supporting the tube-like portion.

* * * * *